US005879537A

United States Patent [19]

Peters

[11] Patent Number: 5,879,537

[45] Date of Patent: Mar. 9, 1999

[54] HYDROCARBON CONVERSION PROCESS USING STAGGERED BYPASSING OF REACTION ZONES

[75] Inventor: Kenneth D. Peters, Elmhurst, Ill.

[73] Assignee: UOP LLC, Des Plaines, Ill.

[21] Appl. No.: 704,224

[22] Filed: Aug. 23, 1996

[51] Int. Cl.[6] ..... C10G 35/04; C10G 51/06

[52] U.S. Cl. ..... 208/134; 208/133; 208/142; 208/145; 208/64; 208/80

[58] Field of Search ..... 208/133, 134, 208/64, 80, 145, 142

[56] References Cited

U.S. PATENT DOCUMENTS

| | | | |
|---|---|---|---|
| 4,104,149 | 8/1978 | Veinerman et al. | 208/64 |
| 4,325,806 | 4/1982 | Peters | 208/64 |
| 4,325,807 | 4/1982 | Peters | 208/64 |

*Primary Examiner*—Glenn Caldarola
*Assistant Examiner*—In Suk Bullock
*Attorney, Agent, or Firm*—Thomas K. McBride; John G. Tolomei; Michael A. Moore

[57] ABSTRACT

A multistage catalytic hydrocarbon conversion system is disclosed in which hydrocarbons flow serially through at least two reaction zones and through which catalyst particles move. Where three reaction zones are used, the effluent stream from the first reaction zone is split between the second and third reaction zones. One portion of the effluent stream is combined with hydrocarbons that bypassed the first reaction zone, and the combined stream is passed to the second reaction zone. The other portion of the first reaction zone effluent stream and at least a portion of the effluent stream of the second reaction zone are passed to the third reaction zone. This invention is applicable to processes where the first and second reaction zones are susceptible to pinning in that this invention decreases the mass flow through the first and second reaction zones while nevertheless maintaining high hydrocarbon conversion.

12 Claims, 1 Drawing Sheet

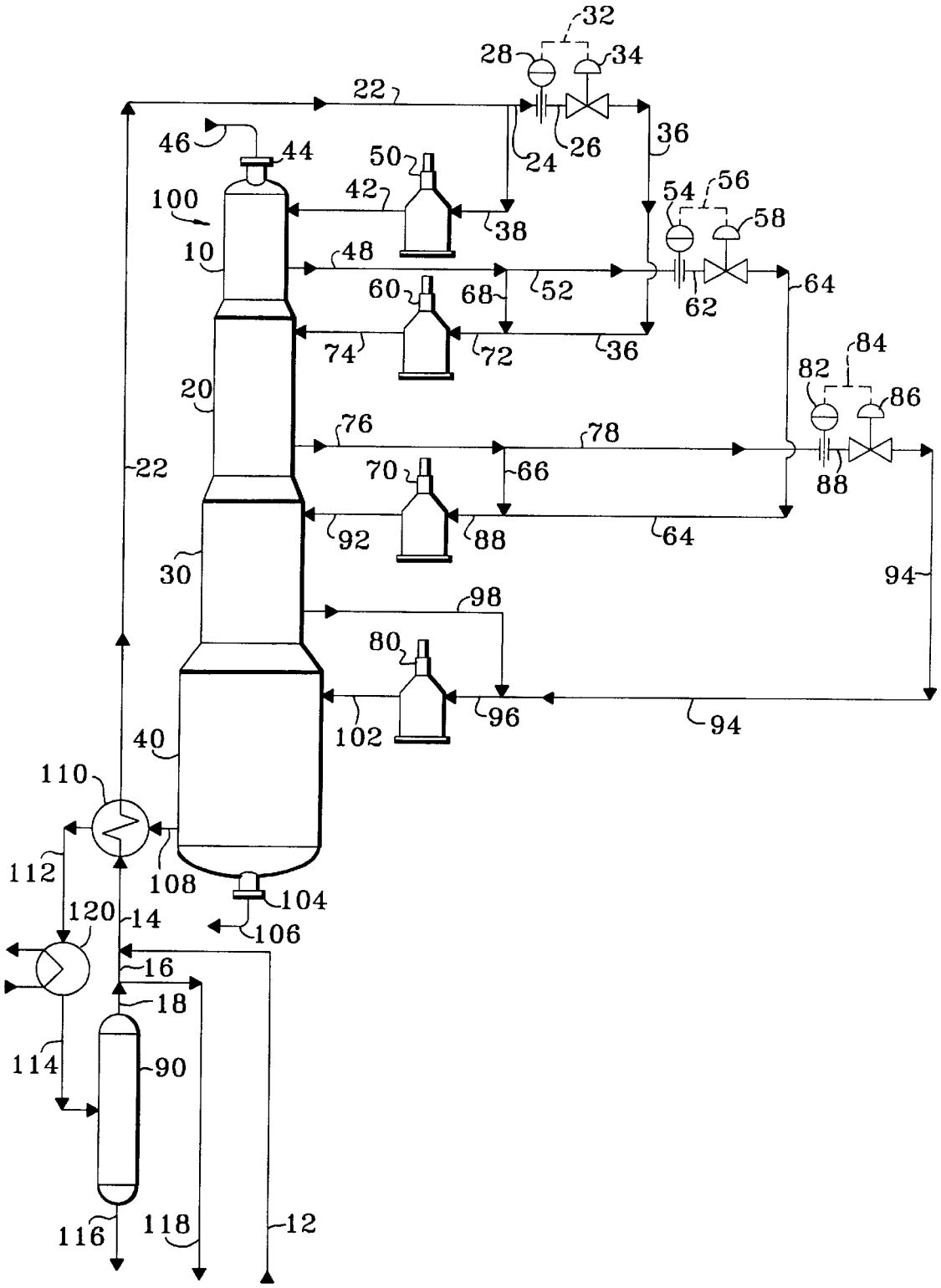
32
28
34
22
46
44
50
24
26
36
42
54
56
100
38
58
10
48
52
64
60
68
62
74
72
36
84
82
86
20
76
78
22
70
66
88
92
88
64
30
94
98
80
96
94
102
40
110
112
108
104
120
14
106
16
18
114
90
116
118
12

HYDROCARBON CONVERSION PROCESS USING STAGGERED BYPASSING OF REACTION ZONES

FIELD OF THE INVENTION

The field of this invention is hydrocarbon conversion processing in multiple reaction zones.

BACKGROUND OF THE INVENTION

Hydrocarbon conversion processes often employ multiple reaction zones through which hydrocarbons pass in series flow. Each reaction zone in the series often has a unique set of design requirements. A minimum design requirement of each reaction zone in the series is the hydraulic capacity to pass the desired throughput of hydrocarbons that pass through the series. An additional design requirement of each reaction zone is the capability to perform a specified degree of hydrocarbon conversion. Designing a reaction zone for a specified degree of hydrocarbon conversion, however, often results in a reaction zone being designed larger than the minimum size required for hydraulic capacity alone. Consequently, in a hydrocarbon conversion process having multiple reaction zones with series flow of hydrocarbons, one reaction zone may have more hydraulic capacity than some other reaction zone in the series. For example, in a hydrocarbon reforming process, the last or second-to-last reforming reaction zone often has excess hydraulic capacity in comparison with the first or second reforming reaction zone.

Generally, such excess hydraulic capacity for additional throughput is not detrimental to the performance of the oversized reaction zone or any other reaction zone in the series. In theory, a process unit with extra hydraulic capacity in one or more of the reaction zones in the series could run for years with no ill effects. Nevertheless, perhaps years later when the process unit is revamped for increased throughput, an interesting debottlenecking dilemma arises: How can the extra, heretofore-unused hydraulic capacity in a large reaction zone be effectively used, in light of the fact that two or more smaller reaction zones in the series may have little or no excess hydraulic capacity?

As answers to this question, the prior art provides two debottlenecking solutions that involve re-routing the flow of hydrocarbons around two smaller consecutive reaction zones in the series. One prior art solution involves bypassing a portion (B %) of the total (100%) hydrocarbon flow through a bypass line entirely around the two smaller reaction zones, passing the remainder (100% minus B %) of the total flow of hydrocarbons in series-flow through the two smaller reaction zones in the series, combining the bypassed portion with the effluent of the second of the two smaller reaction zones, and passing the total flow of hydrocarbons through the larger reaction zone(s) only. The flow of hydrocarbons through the series can then be increased to the lesser of the combined hydraulic capacity of the smallest reaction zone and the bypass line or the smallest hydraulic capacity of the other larger reaction zone(s) of the series. The primary disadvantage of this solution, of course, is that all of the hydrocarbons that bypass one of the smaller reaction zones also bypass the other smaller reaction zone. Another disadvantage of this solution is that of the total hydrocarbons that pass through the series, only 100% minus B % passes through both of the two smaller reaction zones. Therefore, on average the hydrocarbons pass through fewer reaction zones, contact less catalyst or otherwise experience hydrocarbon conversion conditions for a shorter time, and therefore undergo less hydrocarbon conversion. Where a portion of the total flow of hydrocarbons is bypassed around more than two reaction zones, the disadvantages are compounded.

Another prior art solution involves placing two consecutive smaller reaction zones in parallel-flow rather than in series-flow, and passing only part rather than all of the hydrocarbons through each parallel reaction zone. This solution combines the smaller, parallel-flow reaction zones effectively into one large reaction zone that is in series-flow with the other larger reaction zone(s) of the series. The flow of hydrocarbons through the series can then be increased to the lesser of the combined hydraulic capacity of the parallel-flow reaction zones or the smallest hydraulic capacity of the other larger reaction zone(s) of the series. Although this second solution has an advantage in that none of the hydrocarbons that bypass one of the parallel-flow reaction zones also bypasses the other parallel-flow reaction zone, the disadvantage of this second solution is that none of the total hydrocarbon flow through the series passes through both of the two smaller reaction zones. The more smaller reaction zones placed in parallel, the greater are the disadvantages of this second solution.

Consequently, a method is sought for passing hydrocarbons through multiple reaction zones where a portion of the total reactant flow must be bypassed around two or more consecutive reaction zones, but where nevertheless the detrimental effects on hydrocarbon conversion are minimized. The method must prevent hydrocarbons that bypass one of the reaction zones from also bypassing the next reaction zone in the series. Furthermore, the method must maximize the total amount of hydrocarbon that passes through all of the reaction zones that are bypassed.

SUMMARY OF THE INVENTION

This invention is a method of hydrocarbon conversion wherein a portion of the total hydrocarbon flow is bypassed around more than one reaction zone in a series of two or more reaction zones. In one embodiment of this invention, prior to combining the effluent of a reaction zone with any hydrocarbons that bypassed that reaction zone, the effluent of that reaction zone is first divided into two portions. One portion of the effluent is combined with hydrocarbons that bypassed that reaction zone and the combined stream is passed to the next reaction zone in the series, so that none of the hydrocarbons that bypassed that reaction zone also bypass the next reaction zone in the series. The other portion of the effluent bypasses that next reaction zone in the series and is passed to the one-after-next reaction zone in the series. Because the portion of the effluent that bypasses the next reaction zone is split from the effluent prior to combining the effluent with any hydrocarbons that bypassed the reaction zone which produced the effluent, the method of this invention is called "staggered bypassing."

One of the main advantages of this invention is that none, or 0%, of the hydrocarbons that bypass one of the reaction zones also bypasses the next reaction zone in the series. In this aspect, this invention is as good as the prior art parallel-flow method, wherein none, or 0%, of the hydrocarbons that bypass one reaction zone also bypass the next reaction zone in the series, and is vastly superior to the prior art bypassing method, wherein all, or 100%, of the hydrocarbons that bypass one reaction zone also bypass the next reaction zone in the series.

Another advantage of this invention is that this invention maximizes the total amount of hydrocarbon that passes through all of the reaction zones that are bypassed. In this invention, if $B_1$% is the portion of the hydrocarbon-containing feed to the first reaction zone that is bypassed around the first reaction zone and $B_2$% is the portion of the hydrocarbon-containing effluent of the first reaction zone that is bypassed around the next consecutive reaction zone, then the amount of the total hydrocarbon flow to the series that passes through both reaction zones is the product, (100 minus $B_1$%) times (100 minus $B_2$%), expressed as a percentage. For example, if 10% of the hydrocarbon flow to the series is to be bypassed around each reaction zone, then $B_1$% is 10%, $B_2$% is 11.1%, and the product (100% minus $B_1$%) times (100% minus $B_2$%) is 80%. In this example, then, this invention passes 80% of the hydrocarbon flow to the series through both reaction zones, compared to only a slightly higher value of 100% minus 10%, or 90%, for the prior art bypassing method and a much lower value of 0% for the prior art parallel-flow method.

To summarize these advantages, this invention is an improvement over the prior art bypassing method because, while this invention passes only slightly less hydrocarbons through both reaction zones, this invention bypasses no hydrocarbons around both reaction zones. This invention is also an improvement over the prior art parallel-flow method because, while neither bypasses hydrocarbons around both reaction zones, this invention passes much more hydrocarbons through both reaction zones. It is believed that by both minimizing the hydrocarbons that bypass both reaction zones and maximizing the hydrocarbons that pass through both reaction zones, this invention results in a higher degree of hydrocarbon conversion in comparison to the prior art methods.

This invention is particularly advantageous for those hydrocarbon conversion processes that employ not only a series of reaction zones but, because the reactions are endothermic or exothermic, also employ a series of intermediate heating or cooling zones between the reaction zones. By using this invention, the duties of the intermediate heating or cooling zones between the earlier or upstream reaction zones in the series can be shifted to later or downstream reaction zones in the series. This can be advantageous for those processes that require debottlenecking of not only of the reaction zones but also of the intermediate heating or cooling zones.

Although this invention is primarily applicable to revamping to a higher throughput such existing process units that employ a series of reaction zones of which some have more hydraulic capacity than others, this invention is also applicable to new process units that absent this invention would have otherwise been designed for strictly series-flow of hydrocarbons through a series of reaction zones.

In a broad embodiment, this invention is a hydrocarbon conversion process in which a first portion of a hydrocarbon-containing charge stream is passed to a first reaction zone. The hydrocarbons react in the first reaction zone, and a hydrocarbon-containing first effluent stream is withdrawn from the first reaction zone. A second portion of the charge stream and a first portion of the first effluent stream are passed to a second reaction zone. The hydrocarbons react in the second reaction zone, and a hydrocarbon-containing second effluent stream is withdrawn from the second reaction zone. A second portion of the first effluent stream and the second effluent stream are recovered from the process.

In another broad embodiment, this invention is a hydrocarbon conversion process in which a first portion of a hydrocarbon-containing charge stream is passed to a first reaction zone. The hydrocarbons react in the first reaction zone, and a hydrocarbon-containing first effluent stream is withdrawn from the first reaction zone. A second portion of the charge stream and a first portion of the first effluent stream are passed to a second reaction zone. The hydrocarbons react in the second reaction zone, and a hydrocarbon-containing second effluent stream is withdrawn from the second reaction zone. A second portion of the first effluent stream and at least a first portion of the second effluent stream are passed to a third reaction zone. The hydrocarbons react in the third reaction zone, and a hydrocarbon-containing third effluent stream is withdrawn from the third reaction zone.

In another embodiment, this invention is a reforming process in which a hydrocarbon-containing charge stream and a hydrogen-containing recycle stream are combined to form a first combined stream. A first portion of the first combined stream is heated and passed to a first reforming zone, where the hydrocarbons are reformed. A hydrocarbon-containing first effluent stream is withdrawn from the first reforming zone. A second portion of the first combined stream and a first portion of the first effluent stream are combined to form a second combined stream. The second combined stream is heated and passed to a second reforming zone. The hydrocarbons are reformed in the second reforming zone, and a hydrocarbon-containing second effluent stream is withdrawn from the second reforming zone. A second portion of the first effluent stream and a first portion of the second effluent stream are combined to form a third combined stream. The third combined stream is heated and passed to a third reforming zone. In the third reforming zone the hydrocarbons are reformed, and a hydrocarbon-containing third effluent stream is withdrawn from the third reforming zone. A second portion of the second effluent stream and the third effluent stream are combined to form a fourth combined stream. The fourth combined stream is heated and passed to a fourth reforming zone, where the hydrocarbons are reformed and from which a hydrocarbon-containing product stream is recovered.

BRIEF DESCRIPTION OF THE DRAWING

The drawing is a schematic flow diagram of a preferred embodiment of this invention.

INFORMATION DISCLOSURE

U.S. Pat. No. 4,325,806 (Peters) discloses a hydrocarbon conversion process having at least three reaction zones, wherein one portion of the effluent of the first reaction zone is passed to the second reaction zone, and another portion of the effluent of the first reaction zone is combined with the entire effluent of the second reaction zone and passed to a third reaction zone.

U.S. Pat. No. 4,325,807 (Peters) discloses a hydrocarbon conversion process having at least four reaction zones, where the first and second reaction zones are in a parallel-flow arrangement. In addition, the combined effluent of the first and second reaction zones is divided into two portions: one portion is passed to the third reaction zone, and the other portion is combined with the entire effluent of the third reaction zone and passed to the fourth reaction zone.

The teachings of U.S. Pat. Nos. 4,325,806 and 4,325,807 are incorporated herein by reference.

DETAILED DESCRIPTION OF THE INVENTION

This invention is applicable to the catalytic conversion of a hydrocarbon-containing reactant stream in a reaction system having at least two reaction zones where the reactant stream flows serially through the reaction zones. Reaction systems having multiple zones generally take one of two forms, a side-by-side form or a stacked form. In the side-by-side form, multiple and separate reaction vessels, each comprising a reaction zone, are placed along side each other. In the stacked form, one common reaction vessel contains the multiple and separate reaction zones that are placed on top of each other. In both reaction systems, there can be intermediate heating or cooling between the reaction zones, depending on whether the reactions are endothermic or exothermic.

Although the reaction zones can comprise any number of arrangements for hydrocarbon flow such as downflow, upflow, and crossflow, the most common reaction zones to which this invention is applied are radial flow. A radial flow reaction zone generally consists of cylindrical sections having varying nominal cross-sectional areas, vertically and coaxially disposed to form the reaction zone. Briefly, a radial flow reaction zone typically comprises a cylindrical reaction vessel containing a cylindrical outer catalyst retaining screen and a cylindrical inner catalyst retaining screen that are both coaxially-disposed with the reaction vessel. The inner screen has a nominal, internal cross-sectional area that is less than that of the outer screen, which has a nominal, internal cross-sectional area that is less than that of the reaction vessel. The reactant stream is introduced into the annular space between the inside wall of the reaction vessel and the outside surface of the outer screen. The reactant stream passes through the outer screen, flows radially through the annular space between the outer screen and the inner screen, and passes through the inner screen. The stream that is collected within the cylindrical space inside the inner screen is withdrawn from the reaction vessel. Although the reaction vessel, the outer screen, and the inner screen may be cylindrical, they may also take any suitable shape, such as triangular, square, oblong, and diamond, depending on many design, fabrication, and technical considerations. For example, it is common for the outer screen to not be a continuous cylindrical screen but to instead be an arrangement of separate, elliptical, tubular screens called scallops that are arrayed around the circumference of the inside wall of the reaction vessel. The inner screen is commonly a perforated centerpipe that is covered around its outer circumference with a screen.

This invention is preferably applicable to catalytic conversion processes wherein the catalyst comprises particles that are movable through the reaction zones. The catalyst particles are movable through the reaction zone by any of a number of motive devices including conveyors or transport fluid, but most commonly the catalyst particles are movable through the reaction zone by the force of gravity. Typically, in a radial flow reaction zone the catalyst particles fill the annular space between the inner and outer screens, which is called the catalyst bed. Catalyst particles are withdrawn from a bottom portion of a reaction zone, and catalyst particles are introduced into a top portion of the reaction zone. The catalyst particles withdrawn from a reaction zone can subsequently be recovered from the process, regenerated in a regeneration zone of the process, or transferred to another reaction zone. Likewise, the catalyst particles added to a reaction zone can be catalyst that is being newly added to the process, catalyst that has been regenerated in a regeneration zone within the process, or catalyst that is transferred from another reaction zone.

Illustrative reaction vessels that have stacked reaction zones and that may be used to practice this invention are shown in U.S. Pat. Nos. 3,706,536 (Greenwood, et al.) and 5,130,106 (Greenwood, et al.), the teachings of which are incorporated herein by reference. Transfer of the gravity-flowing catalyst particles from one reaction to another, the introduction of fresh catalyst particles, and the withdrawal spent catalyst particles is effected through catalyst transfer conduits.

Experience in the use of such stacked systems, as well side-by-side systems, has shown that there is a constraint on the hydraulic capacity of reaction zones where reactants flow through a moving bed of catalyst particles. This constraint is a phenomenon usually referred to as catalyst hang-up or catalyst pinning. Briefly, pinning occurs in a radial flow reaction zone when the horizontal force of the process vapor on a catalyst particle creates a greater frictional force against either the centerpipe or other catalyst particles than the gravitational force. Consequently, the catalyst particle is "pinned" against the centerpipe and does not flow freely downward through the reaction zone. Pinning is described in more detail at Col. 2, Lines 4–40 of U.S. Pat. No. 5,130,106, which has been cited previously.

Processes having multiple reaction zones to which this invention is applicable include a wide variety of hydrocarbon conversion processes such as hydrogenation, hydrotreating, dehydrogenation, isomerization, dehydroisomerization, dehydrocyclization, cracking, and hydrocracking processes, but the most widely practiced hydrocarbon conversion process to which the present invention is applicable is catalytic reforming. Therefore the discussion of the invention contained herein will be in reference to its application to a catalytic reforming reaction system. It is not intended that such discussion limit the scope of the invention as set forth in the claims.

Catalytic reforming is a well-established hydrocarbon conversion process employed in the petroleum refining industry for improving the octane quality of hydrocarbon feedstocks, the primary product of reforming being motor gasoline. The art of catalytic reforming is well known and does not require detailed description herein.

Briefly, in catalytic reforming, a feedstock is admixed with a recycle stream comprising hydrogen and contacted with catalyst in a reaction zone. The usual feedstock for catalytic reforming is a petroleum fraction known as naphtha and having an initial boiling point of about 180° F. (82° C.) and an end boiling point of about 400° F. (203° C.). The catalytic reforming process is particularly applicable to the treatment of straight run naphthas comprised of relatively large concentrations of naphthenic and substantially straight chain paraffinic hydrocarbons, which are subject to aromatization through dehydrogenation and/or cyclization reactions.

Reforming may be defined as the total effect produced by dehydrogenation of cyclohexanes and dehydroisomerization of alkylcyclopentanes to yield aromatics, dehydrogenation of paraffins to yield olefins, dehydrocyclization of paraffins and olefins to yield aromatics, isomerization of n-paraffins, isomerization of alkylcycloparaffins to yield cyclohexanes, isomerization of substituted aromatics, and hydrocracking of paraffins. Further information on reforming processes may be found in, for example, U.S. Pat. Nos. 4,119,526 (Peters et al.); 4,409,095 (Peters); and 4,440,626 (Winter et al.).

A catalytic reforming reaction is normally effected in the presence of catalyst particles comprised of one or more Group VIII (IUPAC 8–10) noble metals (e.g., platinum, iridium, rhodium, palladium) and a halogen combined with a porous carrier, such as a refractory inorganic oxide. The catalyst may contain 0.05–2.0 wt-% of Group VIII metal. The preferred noble metal is platinum. The halogen is normally chlorine. Alumina is a commonly used carrier. The preferred alumina materials are known as the gamma, eta and theta alumina with gamma and eta alumina giving the best results. An important property related to the performance of the catalyst is the surface area of the carrier. Preferably, the carrier will have a surface area of from 100 to about 500 $m^2/g$. The particles are usually spheroidal and have a diameter of from about 1/16th to about 1/8th inch (1.5–3.1 mm), though they may be as large as 1/4th inch (6.35 mm). In a particular regenerator, however, it is desirable to use catalyst particles which fall in a relatively narrow size range. A preferred catalyst particle diameter is 1/16th inch (3.1 mm).

During the course of a reforming reaction, catalyst particles become deactivated as a result of mechanisms such as the deposition of coke on the particles; that is, after a period of time in use, the ability of catalyst particles to promote reforming reactions decreases to the point that the catalyst is no longer useful. The catalyst must be reconditioned, or regenerated, before it can be reused in a reforming process.

In preferred form, the reforming process will employ a moving bed reaction vessel and a moving bed regeneration vessel, and the present invention is applicable to such a reforming process. Regenerated catalyst particles are fed to the reaction vessel, which is typically comprised of several reaction zones, and the particles flow through the reaction vessel by gravity. Catalyst is withdrawn from the bottom of the reaction vessel and transported to the regeneration vessel. In the regeneration vessel, a multi-step regeneration process is typically used to regenerate the catalyst to restore its full ability to promote reforming reactions. U.S. Pat. Nos. 3,652,231 (Greenwood et al.), 3,647,680 (Greenwood et al.) and 3,692,496 (Greenwood et al.) describe catalyst regeneration vessels that are suitable for use in a reforming process. Catalyst flows by gravity through the various regeneration steps and then is withdrawn from the regeneration vessel and transported to the reaction vessel. Arrangements are provided for adding fresh catalyst as make-up to and for withdrawing spent catalyst from the process. Movement of catalyst through the reaction and regeneration vessels is often referred to as continuous though, in practice, it is semicontinuous. By semicontinuous movement it is meant the repeated transfer of relatively small amounts of catalyst at closely spaced points in time. For example, one batch every twenty minutes may be withdrawn from the bottom of the reaction vessel and withdrawal may take five minutes, that is, catalyst will flow for five minutes. If the catalyst inventory in a vessel is relatively large in comparison with this batch size, the catalyst bed in the vessel may be considered to be continuously moving. A moving bed system has the advantage of maintaining production while the catalyst is removed or replaced.

The drawing illustrates an embodiment of the present invention as applied to a catalytic reforming process. The drawing is presented solely for purposes of illustration and is not intended to limit the scope of the invention as set forth in the claims. The drawing shows only the equipment and lines necessary for an understanding of the invention and does not show equipment such as pumps, compressors, heat exchangers, and valves which are not necessary for an understanding of the invention and which are well known to persons of ordinary skill in the art of hydrocarbon processing.

The drawing shows a common reaction vessel 100 that contains four stacked reaction zones: an upper first reaction zone 10, an intermediate second reaction zone 20, an intermediate third reaction zone 30, and a bottom fourth reaction zone 40. These four reaction zones are sized as to length and annular cross-sectional area of the catalyst bed such that the distribution of the total catalyst volume is 10% in reaction zone 10, 15% in reaction zone 20, 25% in reaction zone 30, and 50% in reaction zone 40. In normal operation, fresh or regenerated catalyst particles are introduced through a line 46 and an inlet nozzle 44 into first reaction zone 10. The catalyst particles flow by gravity from first reaction zone 10 to second reaction zone 20, from second reaction zone 20 to third reaction zone 30, and from third reaction zone 30 to fourth reaction zone 40. The catalyst particles are ultimately withdrawn from common reaction vessel 100 through an outlet port 104 and a line 106. Catalyst particles withdrawn through the line 106 may be transported to a conventional continuous regeneration zone, which is not shown in the drawing. The flow rate of catalyst through the common reactor vessel 100 can be controlled by regulating the rate of withdrawal of catalyst particles through line 106 in order to achieve a desired degree of catalytic performance (i.e., activity of catalyst, yield of desired products, and selectivity of desired products over undesired by-products) in the reaction zones 10, 20, 30, and 40.

Turning next to the flow of hydrocarbons, a straight-run naphtha gasoline fraction boiling in the 180°–400° F. (82°–204° C.) range is charged to the process through a line 12 and is admixed with a hydrogen-rich gas stream flowing through a line 16 to form a combined feed stream. The combined feed stream flows through a line 14 to a heat exchanger 110, which heats the combined feed stream by heat exchange with the effluent stream of fourth reaction zone 40 flowing through a line 108. The heated combined feed stream passes through a line 22 and divides into two portions. Approximately 90% of the combined feed stream becomes the feed stream to the first reaction zone 10. This portion of the combined feed stream passes through a line 38 to a charge heater 50 which heats the stream to the desired temperature of the inlet of first reaction zone 10, and then passes through a line 42 to first reaction zone 10. Typical reaction zone inlet temperatures are from 850° to 1020° F. (454° to 549° C.) at reaction pressures of from 50 to 200 psi(g) (3.5 to 14 $kg/cm^2(g)$). The remaining approximately 10% of the combined feed stream is diverted around both the charge heater 50 and the first reaction zone 10, and is passed to the second reaction zone 20. This diverted portion of the combined feed stream passes through a line 24, flow measuring instrument 28, line 26, regulating valve 34, and line 36, and then enters second reaction zone 20 via line 72, heater 60, and line 74. Control of this portion of the combined feed stream is by means of the regulating valve 34 operated on flow control. A set-point that corresponds to the desired flow rate through the line 24 is present in the instrument 28. The instrument 28 provides a signal 32 that corresponds to the difference between the actual flow rate and the desired flow rate through the line 24.

An effluent stream is recovered from the first reaction zone 10 through a line 48. The effluent stream from the first reaction zone 10 is divided into two portions. Approximately 90% of the effluent stream passes through line 68 and combines with the diverted portion of the combined feed stream flowing through line 36 to form the feed stream to the second reaction zone 20. Because reforming reactions are generally endothermic, the second reaction zone feed stream passes through the line 72 and through the heater 60 which reheats the stream to the desired inlet temperature of the second reaction zone 20. After heating, the second reaction zone feed stream passes through the line 74 to enter second reaction zone 20. The remaining approximately 10% of the effluent stream from the first reaction zone is diverted around both the heater 60 and second reaction zone 20, and is passed to third reaction zone 30. This diverted portion of the first reaction zone effluent stream passes through a line 52, flow measuring instrument 54, line 62, regulating valve 58, and line 64, and enters third reaction zone 30 via line 88, heater 70, and line 92. Control of this portion of the first reaction zone effluent stream is by means of the regulating valve 58 operated on flow control by signal 56 that corresponds to the difference between the actual and desired flow rates through line 52. An effluent stream is recovered from the second reaction zone 20 through a line 76.

The effluent stream from the second reaction zone 20 is divided into two portions. Approximately 90% of the effluent stream passes through line 66 and combines with the diverted portion of the effluent stream from the first reaction zone flowing through line 64 to form the feed stream to the third reaction zone 30. The third reaction zone feed stream passes through the line 88, through the heater 70 which heats the stream to the desired inlet temperature of the third reaction zone 30, and then through the line 92 to enter third reaction zone 30. The remaining approximately 10% of the effluent stream from the second reaction zone is diverted around both the heater 70 and third reaction zone 30, and is passed to fourth reaction zone 40. This diverted portion of the second reaction zone effluent stream passes through a line 78, flow measuring instrument 82, line 88, regulating valve 86, and line 94, and enters fourth zone 40 via line 96, heater 80, and line 102. Control of this portion of the second reaction zone effluent stream is by means of the regulating valve 86 operated on flow control by signal 84. An effluent stream is recovered from the third reaction zone 30 through a line 98.

The effluent stream from the third reaction zone 30 combines with the diverted portion of the effluent stream from the second reaction zone flowing through line 94 to form the feed stream to the fourth reaction zone 40. The fourth reaction zone feed stream passes through the line 96, through the heater 80 which heats the stream to the desired inlet temperature of the fourth reaction zone 40, and then through the line 102 to enter third reaction zone 40. An effluent stream is recovered from the fourth reaction zone 40 through a line 108.

The effluent stream from the fourth reaction zone 40 passes to the heat exchanger 110, which cools the effluent stream by heat exchange with the combined feed stream flowing through the line 14. The fourth reaction zone effluent stream then passes through a line 112 to a cooler 120 which cools the effluent stream to the desired inlet temperature of the separator 90, and then passes through a line 114 to separator 90. In separator 90, the effluent stream is separated into a hydrogen-containing gas stream that is withdrawn through a line 18 and a liquid stream containing the product reformate that is withdrawn through the line 116. One portion of the hydrogen-rich gas stream flows through the line 16, combines with straight-run naphtha being charged to the process, and is recycled to the common reaction vessel 100, as described previously. Another portion of the gas stream is passed through line 118 to conventional product separation facilities, which are not shown in the drawing, for recovery of a hydrogen-rich gas stream. By hydrogen-rich it is meant a gas stream having a hydrogen content of at least 50 mol-%. The product reformate stream is passed through the line 116 to conventional product separation facilities, which are also not shown in the drawing, for recovery of high octane product, for example, a reformate having a research clear octane number rating of about 95.

It should be pointed out that although each reaction zone in the drawing consists of a catalyst bed, an outer screen, and an inner screen, the reaction zones that are within the scope of this invention include reaction zones that comprise two or more reaction vessels, each with a catalyst bed, an outer screen, and an inner screen. Thus, a reaction zone can comprise more than one reaction vessel. Consequently, a stream that bypasses a reaction zone can therefore bypass more than one reaction vessel. For example, a process that has two reaction zones, with the first reaction zone comprising two reaction vessels that are in serial flow, and the second reaction zone comprising one reaction vessel is within the scope of this invention. In this example, the portion of the charge stream that passes to the first reaction zone passes in series flow through the two reaction vessels of the first reaction zone. The effluent of the second reaction vessel of the first reaction zone is, therefore, the effluent of the first reaction zone. Then, in accordance with this invention, a portion of the effluent of the first reaction zone bypasses the second reaction zone, and the remainder of the effluent of the first reaction zone combines with the portion of the charge stream that bypassed the first reaction zone. This example does not limit the scope of this invention as to the number of reaction vessels that comprise a single reaction zone.

Although the amount of diversion or bypass of the total hydrocarbon flow around each reaction zone in the drawing is 10%, it is believed that the benefits of this invention can be achieved if the amount of bypass is generally between about 0.1% and about 99.9% of the total hydrocarbon flow. It is believed, however, that because of process economics and the inevitable loss of conversion the amount of bypass is preferably between about 1% and about 50% and more preferably between about 5% and about 30%.

What is claimed is:

1. A hydrocarbon conversion process comprising:

a) passing a first portion of a hydrocarbon-containing charge stream to a first reaction zone, reacting hydrocarbons in said first reaction zone, and withdrawing from said first reaction zone a hydrocarbon-containing first effluent stream;

b) passing a second portion of said charge stream and a first portion of said first effluent stream to a second reaction zone, reacting hydrocarbons in said second reaction zone, and withdrawing from said second reaction zone a hydrocarbon-containing second effluent stream; and c) recovering a second portion of said first effluent stream and said second effluent stream from said process.

2. A hydrocarbon conversion process comprising:

a) passing a first portion of a hydrocarbon-containing charge stream to a first reaction zone, reacting hydrocarbons in said first reaction zone, and withdrawing from said first reaction zone a hydrocarbon-containing first effluent stream;

b) passing a second portion of said charge stream and a first portion of said first effluent stream to a second reaction zone, reacting hydrocarbons in said second reaction zone, and withdrawing from said second reaction zone a hydrocarbon-containing second effluent stream; and c) passing a second portion of said first effluent stream and at least a first portion of said second effluent stream to a third reaction zone, reacting hydrocarbons in said third reaction zone, and withdrawing from said third reaction zone a hydrocarbon-containing third effluent stream.

3. The method of claim 2 further characterized in that a second portion of said second effluent stream and at least a portion of said third effluent stream are passed to a fourth reaction zone, hydrocarbons are reacted in said fourth reaction zone, and a hydrocarbon-containing fourth effluent stream is recovered from said fourth reaction zone.

4. The process of claim 2 wherein a second portion of said second effluent stream is recovered from said process.

5. The process of claim 2 wherein said second portion of said charge stream and said first portion of said first effluent stream are heated prior to said passing to said second reaction zone.

6. The process of claim 2 wherein said second portion of said first effluent stream and said at least a first portion of said second effluent stream are heated prior to said passing to said third reaction zone.

7. The process of claim 2 wherein said second portion of said charge stream comprises at least 0.1% of said charge stream.

8. The process of claim 7 wherein said second portion of said charge stream comprises between about 5% and about 30% of said charge stream.

9. The process of claim 2 wherein said second portion of said first effluent stream comprises at least 0.1% of said first effluent stream.

10. The process of claim 9 wherein said second portion of said first effluent stream comprises between about 5% and about 30% of said first effluent stream.

11. The process of claim 2 wherein said reacting is selected from the group consisting of reforming, alkylating, dealkylating, hydrogenating, hydrotreating, dehydrogenating, isomerizing, dehydroisomerizing, dehydrocyclizing, cracking, and hydrocracking.

12. A reforming process comprising:

a) combining a hydrocarbon-containing charge stream and a hydrogen-containing recycle stream to form a first combined stream, heating a first portion of said first combined stream, passing said first portion of said charge stream after heating to a first reforming zone, reforming hydrocarbons in said first reforming zone, and withdrawing from said first reforming zone a hydrocarbon-containing first effluent stream;

b) combining a second portion of said first combined stream and a first portion of said first effluent stream to form a second combined stream, heating said second combined stream, passing said second combined stream after heating to a second reforming zone, reforming hydrocarbons in said second reforming zone, and withdrawing from said second reforming zone a hydrocarbon-containing second effluent stream;

c) combining a second portion of said first effluent stream and a first portion of said second effluent stream to form a third combined stream, heating said third combined stream, passing said third combined stream after heating to a third reforming zone, reforming hydrocarbons in said third reforming zone, and withdrawing from said third reforming zone a hydrocarbon-containing third effluent stream;

d) combining a second portion of said second effluent stream and said third effluent stream to form a fourth combined stream, heating said fourth combined stream, passing said fourth combined stream after heating to a fourth reforming zone, reforming hydrocarbons in said fourth reforming zone, and recovering a hydrocarbon-containing product stream from said fourth reforming zone.

* * * * *